US005418980A

United States Patent [19]

Kelly

[11] Patent Number: 5,418,980

[45] Date of Patent: May 30, 1995

[54] FRICTION ENHANCING WRISTBAND

[76] Inventor: Taggert M. Kelly, 1500 Tanbark Cir., Jackson, Mich. 49203

[21] Appl. No.: 314,924

[22] Filed: Sep. 29, 1994

Related U.S. Application Data

[63] Continuation of Ser. No. 74,617, Jun. 11, 1993, abandoned.

[51] Int. Cl.[6] ..... A41D 20/00

[52] U.S. Cl. ..... 2/170; 2/16

[58] Field of Search ..... 2/16, 170, 161.3, 161.8, 2/DIG. 11, 59, 160, 161.1, 162; 602/21, 64; 273/55 R

[56] References Cited

U.S. PATENT DOCUMENTS

| | | | |
|---|---|---|---|
| 2,129,647 | 8/1938 | Mason | 2/170 |
| 2,821,718 | 2/1958 | Hall et al. | 2/162 |
| 3,606,614 | 9/1971 | Dimitroff | 2/159 |
| 4,061,256 | 12/1977 | Beer et al. | 2/170 |
| 4,068,318 | 1/1978 | McMahon | 2/170 |
| 4,183,100 | 1/1980 | De Marco | 2/161.3 |
| 4,224,692 | 9/1980 | Sundberg | 2/161.8 |
| 4,270,228 | 6/1981 | Gaiser | 2/161.8 |
| 4,316,926 | 2/1982 | Kaminstein | 2/161.8 |
| 4,359,973 | 11/1982 | Andrews | 2/161.8 |
| 4,464,796 | 8/1984 | Heissenberger et al. | 2/162 |
| 4,774,727 | 10/1988 | Jackson | 2/161.8 |
| 4,810,559 | 3/1989 | Fortier et al. | 2/16 |
| 4,843,653 | 7/1989 | Coble | 2/170 |
| 4,881,276 | 11/1989 | Swan | 2/161 A |
| 4,896,378 | 1/1990 | Campana | 2/170 |
| 5,146,628 | 9/1992 | Herrmann et al. | 2/161 R |

*Primary Examiner*—Clifford D. Crowder
*Assistant Examiner*—Amy Brooke Vanatta
*Attorney, Agent, or Firm*—Beaman & Beaman

[57] ABSTRACT

A wristband, particularly suitable for athletic use, comprising an elastic moisture absorbing sleeve having a high friction surface located over a major portion of the wristband whereby a ball, such as a football, gripped between the wristband and the wearer's body resists removal or dropping.

8 Claims, 1 Drawing Sheet

FRICTION ENHANCING WRISTBAND

This is a continuation of co-pending application Ser. No. 08/074,617 filed Jun. 11, 1993, now abandoned.

BACKGROUND OF THE INVENTION

1. Field of the Invention The invention pertains to wristbands having both moisture absorbing and friction enhancing characteristics to improve the grip of the athlete carrying the ball between the forearm and the body.

2. Description of the Related Art

Wristbands are commonly worn by athletes for perspiration absorbing purposes. Such wristbands commonly consist of a tubular sleeve of elasticized moisture absorbing fabric such as terry cloth, and surround the forearm wrist region and are used by the athlete to wipe perspiration from the head and face, and are also used to absorb hand perspiration. Wristbands are commonly employed in most highly active sports such as tennis, basketball, baseball and football.

Friction enhancing gloves to improve the catching ability of football pass receivers often utilize friction enhancing materials, as shown in U.S. Pat. Nos. 3,606,614; 4,881,276 and 5,146,628. Such devices are worn upon the athlete's hands and improve the engagement of the athlete's hands with a football in flight to reduce the likelihood of the ball slipping from the hands.

Also, it is known to impregnate a wristband with an anti-slip composition, such as of a sticky nature, wherein a tennis racket handle, or the like, may be rubbed on the wristband to improve the frictional characteristics of the handle as shown in U.S. Pat. No. 4,068,318.

When running with a football, the recommended technique is for the runner to hold the ball in the right or left hand close to the runner's upper torso or chest. The football will extend across the wrist area of the athlete, and by firmly nesting the football between the hand, arm and body, the likelihood of an opponent "stripping" the ball from the runner is reduced. However, as the runner is tackled, or the ball is attempted to be knocked from the runner's grip, it is not uncommon for the football to be inadvertently released or lost by the runner resulting in a possible turnover of the ball to the opponent. Prior to the advent of the instant invention, no friction enhancing apparatus has been available, other than of the aforementioned glove type, to reduce the likelihood of the football being lost by the runner.

OBJECTS OF THE INVENTION

It is an object of the invention to provide a moisture absorbing wristband having a high friction material attached to a portion of the outer surface of the wristband to enhance friction between the wristband and a carried ball.

Another object of the invention is to provide an athletic wristband having a high friction outer surface material, and which is also capable of absorbing moisture.

Yet another of the invention is to provide an athletic wristband having a high friction surface disposed about a portion of the wristband outer surface wherein the wristband remains flexible, arm conforming, easy to clean and comfortable to wear.

SUMMARY OF THE INVENTION

The basic component of a wristband constructed in accord with the invention comprises a tubular sleeve of an elasticized moisture absorbing material such as terry cloth. Conventional wristbands are commonly formed of terry cloth, and the wristband sleeve snugly fits the wearer's wrist and forearm and includes an outer surface having a circumference and ends and end regions.

A high friction material is defined on the outer surface of the fabric sleeve throughout a good portion of the sleeve circumference, preferably at least fifty percent of the circumference. The high friction material, preferably, is of a rubber like consistency which is not tacky or otherwise would leave a tacky film or surface upon the ball, or clothing. The friction material could be sprayed upon the sleeve outer surface, or may consist of a fabric or patch which is sewn to the surface. One suitable friction material consists of an open weave netting coated with a rubber or latex material, such as commonly used as a non-slip backing for throw rugs and carpet, and this material may be sewn to the sleeve circumference.

Preferably, the friction material has a length less than the overall length of the sleeve whereby the end regions of the sleeve will be free of the friction material and available for perspiration absorbing purposes. Likewise, as it is preferred that the friction material does not encompass the entire circumference of the sleeve a portion of the sleeve central region will be available for perspiration absorbing purposes.

The high friction material must be flexible and close conforming to the sleeve configuration as to not adversely affect the movement and flexibility of wrist action, must not interfere with arm movement, and must be unobtrusive in use. Further, it is preferred that the friction material be readily washable so that wristband may be easily kept in a clean condition.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 2:
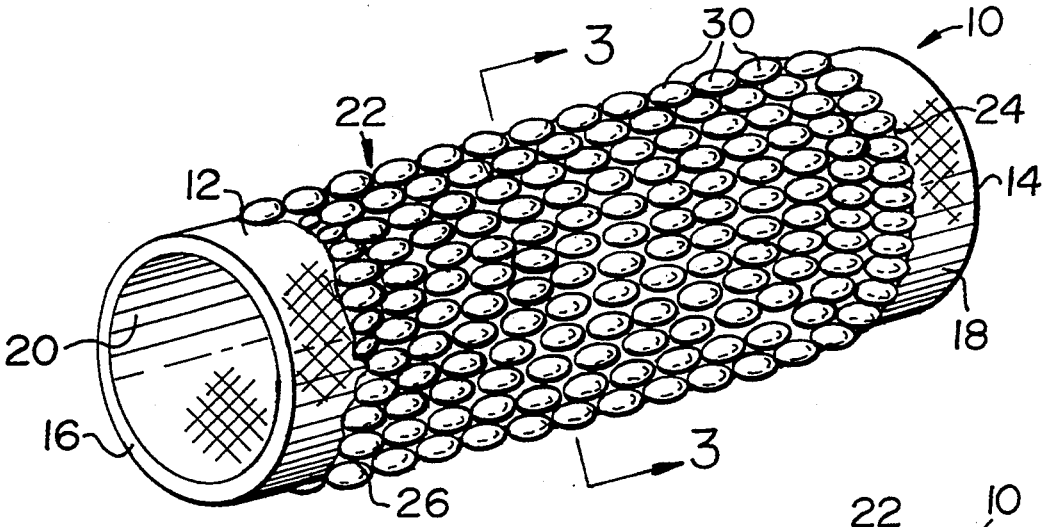
FIG. 2 is a perspective view of a high friction wristband in accord with the invention.

A wristband utilizing the friction enhancing characteristics of the invention is illustrated in FIG. 2 wherein the wristband is generally indicated at 10. The wristband consists of a tubular sleeve 12 formed of an elasticized moisture absorbing fabric, such as terry cloth. The wristband is of an inner diameter as to snugly receive the wearer's forearm, and in a typical embodiment the wristband will be approximately five to eight inches in length.

The sleeve 12 includes opposite ends 14 and 16, an outer surface 18 and an inner diameter or surface 20.

Figure 3:
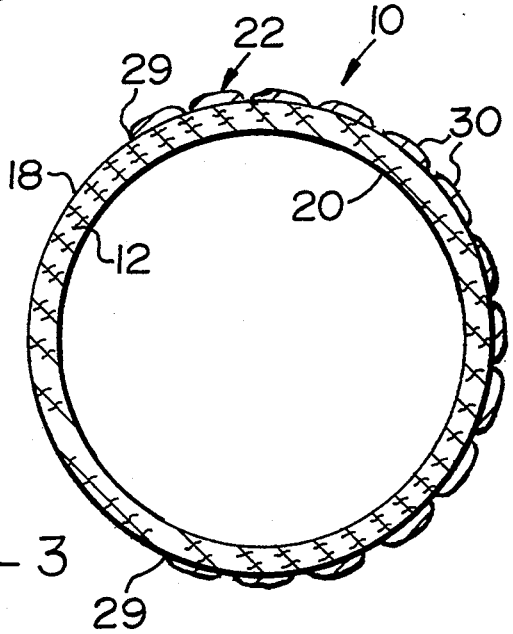
FIG. 3 is a diametrical sectional view through the wristband as taken along Section 3—3 of FIG. 2.

A high friction material generally indicated at 22 is located upon the sleeve outer surface 18, and as will be appreciated from FIG. 3 preferably extends at least fifty percent about the circumference of the sleeve outer surface 18. Lengthwise, the friction material 22 is defined by ends 24 and 26, and circumferentially, by lateral edges 29.

The friction material 22 has an axial length as defined by the ends 24 and 26 less than the axial length of the sleeve 12 as defined by ends 14 and 16 whereby end regions will be defined on the sleeve outer surface adjacent the sleeve ends free of the friction material. Likewise, the circumference of the sleeve 12 intermediate the friction material lateral edges 29 will be exposed for perspiration absorbing purposes.

Figure 4:
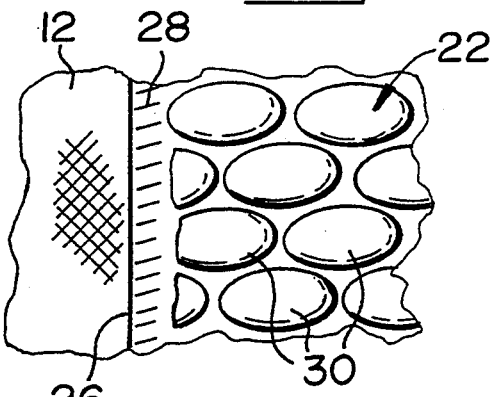
FIG. 4 is an enlarged elevational detail view of a wristband utilizing the inventive concepts illustrating the sewn edge of the high friction fabric with respect to the moisture absorbing portion of the wristband.

The friction material 22 may take a variety of forms. For instance, the friction material could consist of a material sprayed upon the sleeve outer surface 18 capable of bonding to the sleeve outer surface and drying to a non-tacky but high friction characteristic. In a preferred embodiment the friction material 22 consists of an open weave or net fabric having rubberized or latex knobs 30 adhering thereto, and the friction material is sewn to the sleeve 12 at 28, FIG. 4, and along edges 29. This type of friction material is similar to that used on the backs of throw rugs and the like to prevent rug slippage, and the material is highly flexible, somewhat porous as to prevent overheating of the wearer's arm, readily washable, and highly flexible as not to interfere with the flexibility of the wristband.

Figure 1:
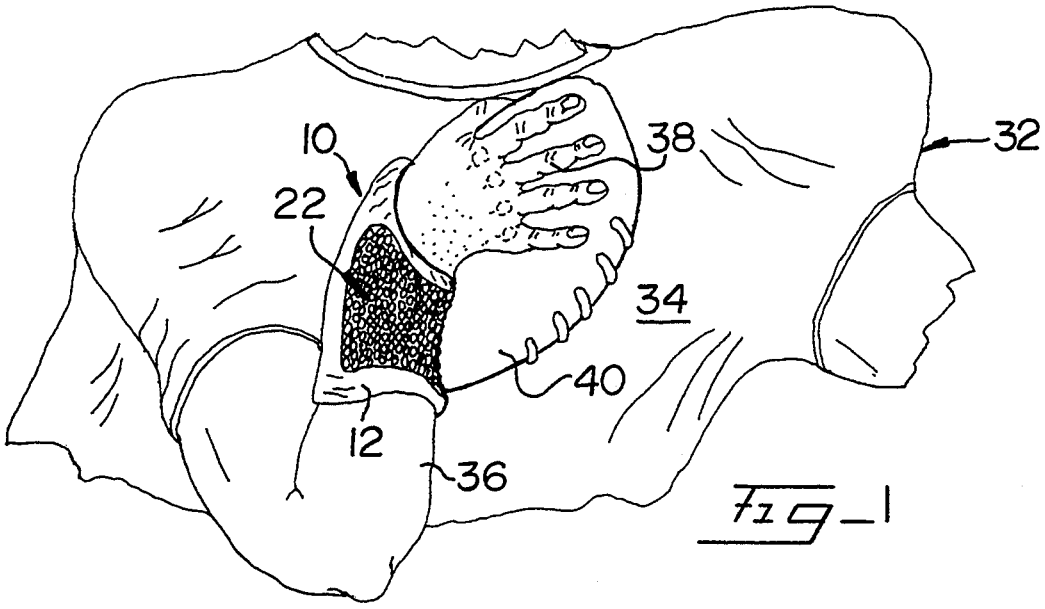
FIG. 1 is a detail perspective view of a football player carrying a football in a typical manner utilizing a friction enhancing sleeve in accord with the invention.

In use, the player 32 having a chest and upper torso 34 places the wristband 10 upon the forearm 36 as will be appreciated from FIG. 1. The wristband will be "rotated" upon the forearm such that the friction material 22 will be disposed toward the wearer's body when the wearer's arm is brought against the chest 34. Thereupon, upon the player 32 grasping a football 40 within his hand 38 the wristband 10, and the friction material 22, will be engaging the ball as the player's arm 38 nestles and cradles the football 40 against the chest 34. A football 40, so gripped, will have a high frictional relationship with the wristband 10, and hence, the player's forearm 36, and the likelihood of the football 40 being released upon the player being tackled, or the football endeavoring to be stripped from the player's grip by opponents is reduced.

The fact that a considerable portion of the sleeve 12 at the end regions and a portion of the central region circumference is free of the friction material 22 permits the wristband to still function for perspiration absorbing purposes as the wearer wipes his face with the wristband. Due to the elastic gripping by the wristband of the wearer's forearm 36, the likelihood of the wristband accidently rotating on the forearm is minimized, but the wearer may rotationally position the wristband upon the forearm as desired.

It is appreciated that various modifications to the inventive concepts may be apparent to those skilled in the art without departing from the spirit and scope of the invention.

I claim:

1. A friction enhancing wristband to aid in the carrying of balls by a wearer comprising, in combination, a tubular sleeve of elastic moisture absorbing material having a length, an outer surface, a circumference, ends and outer surface end regions adjacent said ends, and a high friction material defined on said sleeve outer surface over a portion of said circumference to reduce slippage between said sleeve and a ball being carried interposed between said sleeve and the wearer, said high friction material including lateral edges extending in the direction of the length of said sleeve, said lateral edges being circumferentially spaced from each other to expose a portion of said sleeve outer surface throughout its length for external moisture absorbing purposes, said high friction material comprising a plurality of spaced rubberized knobs projecting outwardly from said sleeve outer surface wherein said knobs engage a ball being carried interposed between said sleeve and the wearer.

2. In a friction enhancing wristband as in claim 1, said high friction material being located about at least 50% of the circumference of said sleeve.

3. In a friction enhancing wristband as in claim 1, said high friction material being directly adhered to said sleeve outer surface.

4. In a friction enhancing wristband as in claim 1, said high friction material comprising a fabric material attached to said sleeve outer surface and said knobs being formed on said fabric material.

5. In a friction enhancing wristband as in claim 4, said fabric material being coated with a rubberized material.

6. In a friction enhancing wristband as in claim 1, said high friction material encompassing at least 50% of said sleeve circumference and said end regions being free of said high friction material to expose circumferential portions of said sleeve for external moisture absorbing purposes.

7. A friction enhancing wristband to aid in the carrying of balls by a wearer comprising, in combination, a tubular sleeve of elastic moisture absorbing material having a length, an outer surface, a circumference, ends and outer surface end regions adjacent said ends, and a high friction material defined on said sleeve outer surface over a portion of said circumference to reduce slippage between said sleeve and a ball being carried interposed between said sleeve, and the wearer, said high friction material comprising a plurality of spaced rubberized knobs projecting outwardly from said sleeve outer surface wherein said knobs engage a ball being carried interposed between said sleeve and the wearer.

8. A friction enhancing wristband to aid in the carrying of balls by a wearer comprising, in combination, a tubular sleeve of elastic moisture absorbing material having a length, an outer surface, a circumference, and ends, and a patch of high friction, rubberized, flexible material defined on said sleeve outer surface over a portion of said circumference to reduce slippage between said sleeve and a ball being carried interposed between said sleeve and the wearer, said patch of high friction, rubberized, flexible material including lateral edges extending in the direction of the length of said sleeve, said lateral edges being circumferentially spaced from each other to expose a portion of said sleeve outer surface throughout its length for external moisture absorbing purposes.

* * * * *